United States Patent [19]

Glover et al.

[11] Patent Number: 4,998,390

[45] Date of Patent: Mar. 12, 1991

[54] PANEL SUPPORT STRUCTURE

[75] Inventors: John E. S. Glover, Angmering; Timothy N. Glover, Worthing, both of England

[73] Assignee: Thermabate Limited, Angmering, England

[21] Appl. No.: 393,694

[22] Filed: Aug. 14, 1989

[30] Foreign Application Priority Data

Aug. 16, 1988 [GB] United Kingdom ..... 8819398
Jan. 26, 1989 [GB] United Kingdom ..... 8901744

[51] Int. Cl.[5] ..... E04B 1/76

[52] U.S. Cl. ..... 52/95; 52/404; 52/712; 52/713

[58] Field of Search ..... 52/404, 238, 241, 94, 52/288, 287, 773, 667, 95, 713, 712

[56] References Cited

U.S. PATENT DOCUMENTS

| | | | |
|---|---|---|---|
| 3,206,806 | 9/1965 | Powell | 52/288 |
| 3,321,882 | 5/1967 | Stahlhut | 52/484 |
| 3,323,264 | 6/1967 | Cross | 52/288 |
| 3,606,714 | 9/1971 | Arnett | 52/288 |
| 3,736,012 | 5/1973 | Boylan | 52/488 |
| 4,161,856 | 7/1979 | Brown | 52/667 |
| 4,769,965 | 9/1988 | Shaub | 52/488 |

*Primary Examiner*—John E. Murtagh
*Attorney, Agent, or Firm*—Lon H. Romanski

[57] ABSTRACT

There is described a supporting strip for retaining the edge of a plasterboard panel (6) adjacent a wall of a building. The strip (16) comprises a first flange (**16*b*, 31) attachable to the wall as by nailing, a second flange (16*a*, 30) extending horizontally from the upper edge of the first, and locating member (16*c*, 33) extending from the first flange at a distance below the second flange to engage the underside of the plasterboard panel and support its edge. The locating member may be a solid flange (16*c*), or may be a series of bendable portions (33) of the first flange (31**) which are deformed out of the plane of the first flange about substantially vertical axes (BB).

An insulation-receiving channel section (17, 20) may be formed integrally with or joined to the supporting strip.

13 Claims, 8 Drawing Sheets

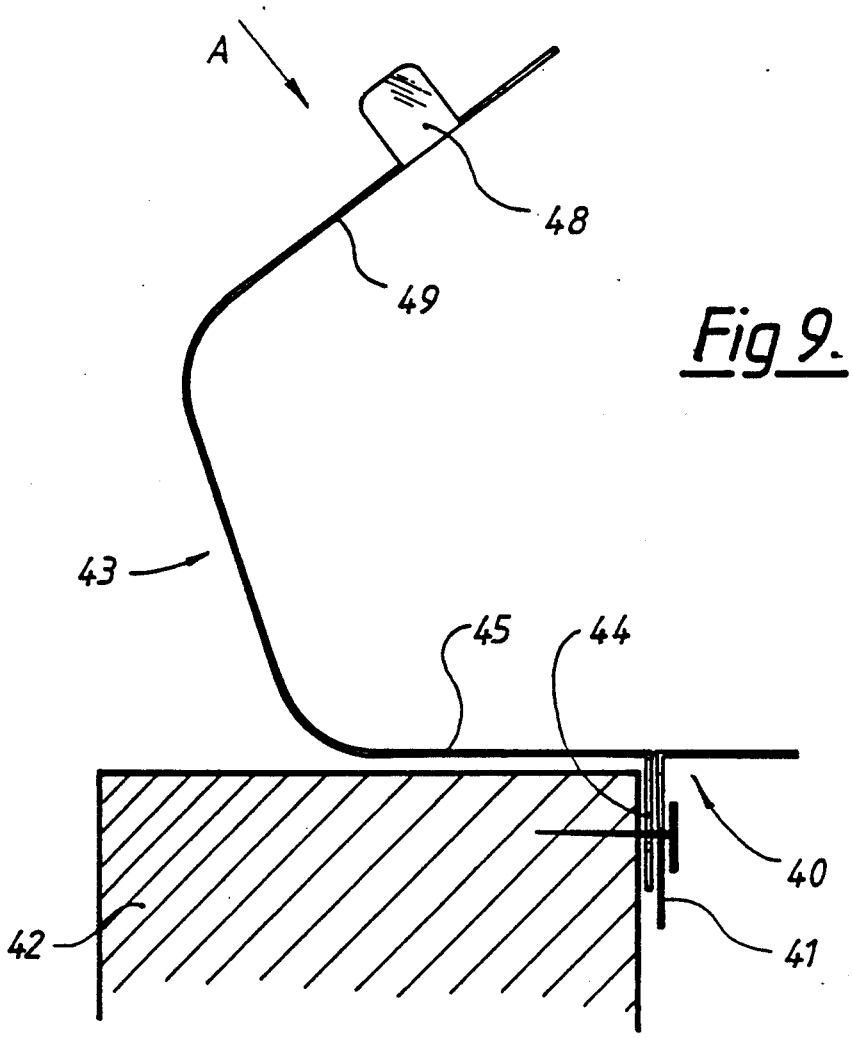
Fig 9.
Fig 9a.
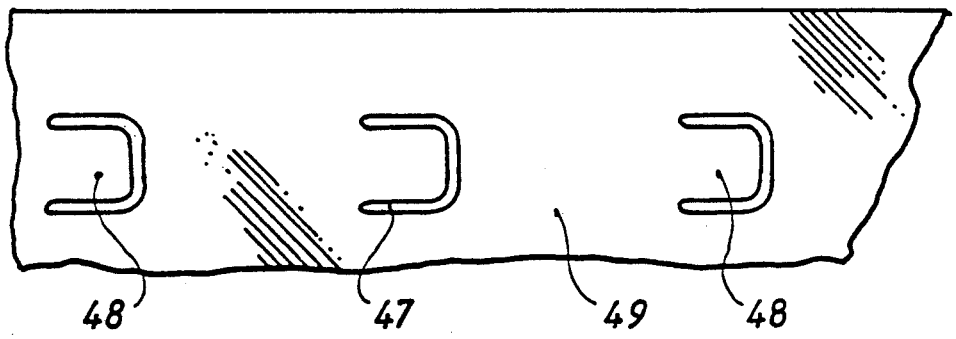

PANEL SUPPORT STRUCTURE

FIELD OF THE INVENTION

The present invention relates to components for supporting panel edges, and particularly concerns supports for

BACKGROUND OF THE INVENTION

Plasterboard ceiling panels have conventionally been fixed in position by nailing them to timber joists or rafters, the edges of adjacent panels being held in alignment by fixing timber noggins between the joists at appropriate locations and nailing the abutting panel edges to the noggin.

At locations where a plasterboard panel meets a wall, the plasterboard is fixed at its edge by nailing upwardly into a batten extending partially across the wall plate and partially over the ceiling panel.

It is also good building practice to insulate the roof of a building with insulation material laid over the plasterboard ceiling between the rafters.

It is most desirable that the insulation material extends over the external cavity wall of the building to prevent a cold bridge where the cavity is closed.

Insulation material, usually in the form of quilting, is pushed into position between the rafters after the plasterboard has been fixed, but it is difficult to ensure that it reaches the full extent of the area to be covered, because the end of the plasterboard is nailed to a batten to prevent it sagging, and this batten projects above the top level of the plasterboard.

The present invention seeks to provide a support which may be fixed to the wall along the perimeter of a room below the rafters or joists, and which may receive and support the edge of the plasterboard.

SUMMARY OF THE INVENTION

According to the present invention, an elongate strip for supporting a ceiling panel edge adjacent a wall comprises a first flange adapted to be fixed to the wall, a second flange extending longitudinally substantially perpendicularly to the first and adapted to overlie the panel in its final position, and locating means extending from the first flange at a predetermined distance below the second flange and adapted to engage the underside of the panel in its final position. In a preferred embodiment, the support includes a channel-like upstand to receive insulation material laid over the ceiling panel, to prevent the insulation material extending beyond the wall when it is pushed into position over the plasterboard.

It is a further feature that the upstand may be stepped or sloped down beyond the wall plate to ensure that insulation material reaches the top of the wall, and may also extend upwards and inwards to provide a gap for the passage of air into the roof space between the underside of the sloping roof and the insulation material. It is a further feature that the process of insulating the roof space can be carried out in two stages, with the support and upstand fixed in position, and the upstand filled with insulation material first, and the ceiling then plasterboarded and the remaining area of the roof space insulated afterwards.

It is a further feature that the upstand can be separate from, and attached to, the plasterboard support. The support and upstand can be made by extruding moulding or vacuum-forming in polyvinyl chloride, or similar plastics material, or by forming sheet steel or other metal into the required shape.

The present invention further provides a method of installing a plasterboard ceiling in a room, wherein a supporting strip of the invention is first fixed round the walls of the room immediately below the joists or rafters, plasterboard panels are then offered up to the joists or rafters with the upper face of the plasterboard engaging the second flange of the supporting strip, the plasterboard is then nailed to the rafters to support the panel, the edges of panels adjacent the walls of the room being supported by the locating means of the strip. The locating means may be a third flange extending parallel to the second flange to define a channel, or may comprise a series of bendable tabs extending from the first flange to underlie the plasterboard panel in their extended positions.

Various embodiments of the present invention will now be described in detail, with reference to the accompanying drawings.

BRIEF DESCRIPTION OF THE DRAWINGS

In the drawings, wherein for purposes of clarity certain details and/or elements may be omitted from one or more views:

FIGS. 9 and 9*a* are an end view and a partial plan view, respectively, of a further embodiment of the insulation retaining upstand usable with the plasterboard support of FIGS. 5*a* and 5*b*.

DETAILED DESCRIPTION OF THE PREFERRED EMBODIMENTS

Figure 1:
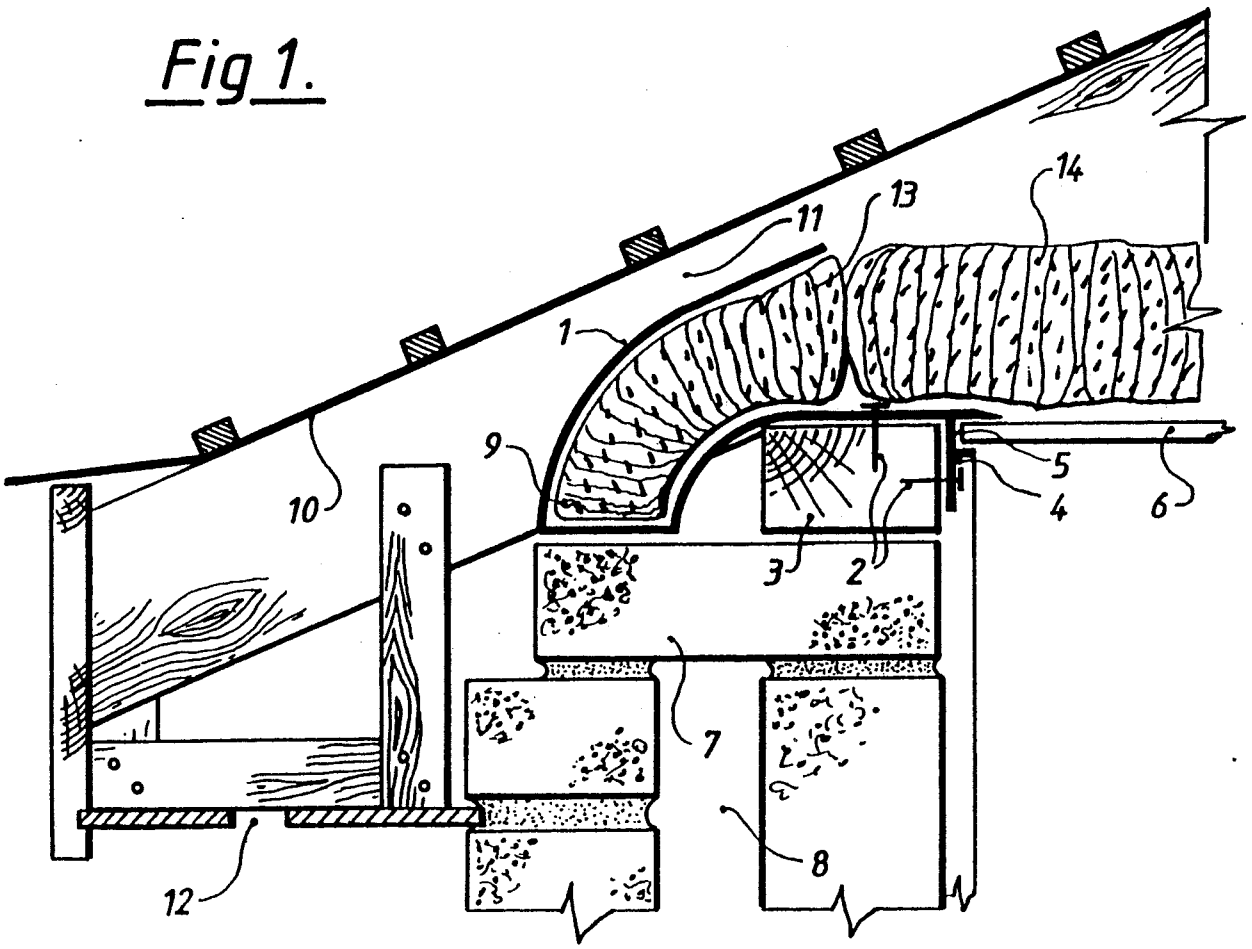
FIG. 1 is a sectional side elevation through the junction of a roof of a building and the external wall.

Referring now to FIG. 1 there is shown a plasterboard and roof insulation support 1 nailed 2 on top of a wallplate 3 of a cavity wall. Alternatively, the support may be fixed by nailing through a flange 4 which extends down the inner leaf of the wall and has a channel 5 into which the edge of a plasterboard ceiling panel 6 may be inserted. The support member extends across the wall plate 3 and turns down beyond the wall plate to meet the brick or block 7 which closes the upper edge of the cavity 8 in the wall. The support then extends upwards to form an end barrier 9, and finally extends parallel to inclined roof 10, sloping with the roof to provide an air gap 11 between the support and the underside of the roof, and to prevent insulation material from protruding beyond the external wall to hinder the passage of air through the soffit of the eaves 12. Insulation material 13, in the form of quilting, is pushed into the support member, and the ceiling is plasterboarded, the plasterboard 6 being nailed to the rafters and supported along its edge adjacent the wall by this edge being received within the channel 5 provided. Further insulation material 14 may then be laid over the plasterboarded ceiling, this material being pushed up against the insulation already placed within the plasterboard and insulation support member.

Figure 2:
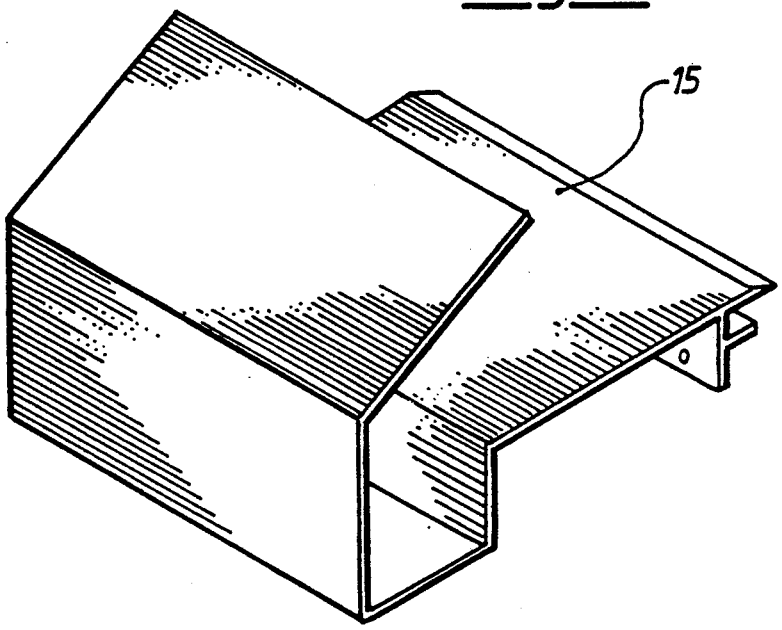
FIG. 2 is a perspective view of a combined plasterboard support and upstand.

FIG. 2 is a perspective view of the integral plasterboard and roof insulation support, illustrating that the section can have angular junctions rather than curves. The support member is beveled at the edge 15, to facilitate insulation material being slid over the junction of the plasterboard and the plasterboard and insulation support.

Figure 3:
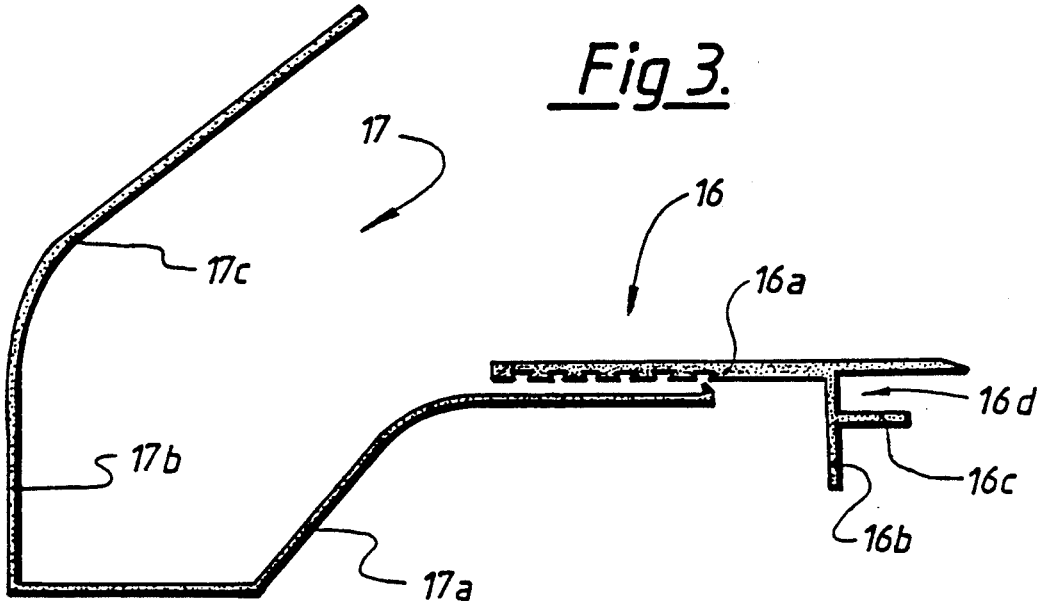
FIG. 3 is a side view of a plasterboard support and upstand, formed as two separate components.

Referring now to FIG. 3, this is a transverse sectional view of a plasterboard and roof insulation support formed in two parts; a plasterboard support 16 and an upstand 17. The plasterboard support 16 is an elongate element comprising an upper horizontal flange 16*a*, a vertical depending web 16*b*, and a second horizontal flange 16*c* extending from the depending web 16*b* to define a channel 16*d* into which an edge of a plasterboard panel may be received.

The upstand 17 comprises a stepped lower side 17*a*, a vertical end wall 17*b*, and an upper wall 17*c* extending obliquely upwardly from the end wall 17*b*. Along the free edge of the lower side extends an upstanding rib 18 which is cooperable with one of a number of slots 19 in the underside of the upper flange 16 of the plasterboard support.

As is clear from FIG. 3, the plasterboard and roof insulation support is installed by first placing the plasterboard support 16 in position on the wall plate with the web 16*b* extending down on the inside of the inner leaf of the wall, and securing the support 16 by nailing either through the web 16*b* or the flange 16*a*, positioning the nails so as not to obstruct the slots 19.

The upstand 17 is then offered into position by lifting the slotted portion of the flange 16*a* and placing the free ed of the lower side 17*a* of the upstand thereunder; the rib 18 is arranged to enter one of the slots 19 so as to locate the lower wall 17*a* in a position spanning the cavity and resting on top of the outer leaf of the wall.

The installation of ceiling panels and insulation material is carried out as described above.

Figure 4:
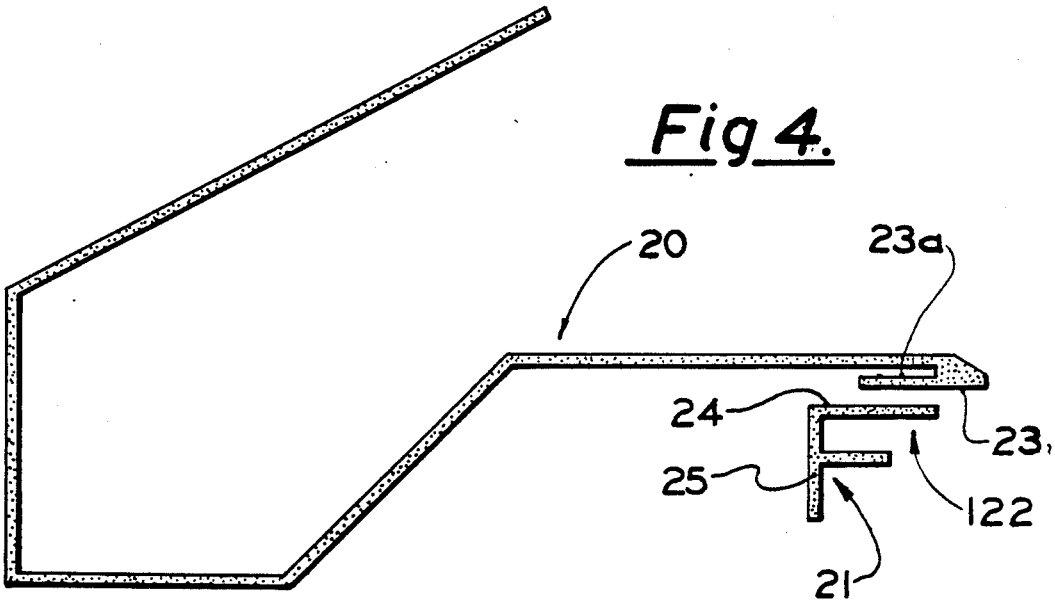
FIG. 4 is a side view of an alternative plasterboard support and upstand, comprising two separate components.

Referring now to FIG. 4, there is seen a sectional view of an alternative plasterboard and roof insulation support, in two parts, the plasterboard support 21 having an upper flange 24, a vertical web 25 depending from one edge of the upper flange 24, and the upstand 20 being located to the plasterboard support by means of a channel section 23 fitting over the free edge of the upper flange 24. A retaining projection 23*a* within the channel 23 is engageable with one of a number of grooves 122 in the underside of the upper flange 24, to prevent the two components from pulling apart, and preformed nail holes may be provided in the web 25 or the flange 24 for fixing the plasterboard support member to the wall or to the rafters above.

An advantage of this embodiment is that the plasterboard support 21 may be installed after the rafters are in position, since no part of the flange 24 extends over the top of the wall plate. The upstand 20, formed preferably of extruded plastics material, can be easily cut to length so as to fit between the ends of the rafters, and each section is easily pushed into place from below the ceiling prior to installing the plasterboard.

Figure 5B:
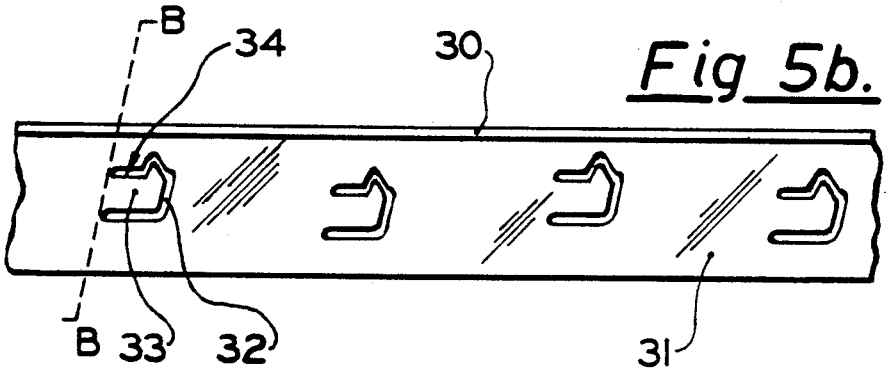
FIGS. 5*a* and 5*b* show an end view and a side view, respectively of a plasterboard support strip.
Figure 5A:
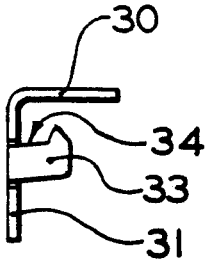

Referring now to FIGS. 5*a* and 5*b*, an alternative construction for the plasterboard support strip is shown. The strip of FIGS. 5*a* and 5*b* comprises an angle section having an upper horizontal flange 30, and a vertical web 31 depending from the flange 30 to form an inverted "L" section.

The web 31 is formed with two longitudinal rows of "C" shaped slots 32, which define bendable tabs 33 of substantially rectangular form. The purpose of the tabs 33 is to support the underside of a plasterboard panel, as will now be explained.

In use, the plasterboard support is fixed to a wall plate by means of nails passing through the web 31. Preformed holes or nailing marks may be provided to ensure an adequate nailing pitch. The plasterboard ceiling panel is then offered up to the rafters and nailed thereto when its edge abuts the web 31. The panel is then urged upwards into close contact with the flange 30, and the tabs 33 are bent out of the plane of the web 31 by inserting a screwdriver or similar tool into the slot 31 and levering the tabs 33 up. The slots 32 may be configured so that the bending axis BB is vertical, in which case the tabs 32 will be positioned in the web 31 so that their edges 34 will be spaced from the underside of the flange 30 by a distance equal to the thickness of the panel.

Alternatively, as shown in the Figures, the bending axis BB may be inclined to the vertical so that as the tabs 32 are bent out of the plane of the web 31 the upper edge 34 of the tab rises by a short distance. This rising motion assists in urging the panel into close engagement with the flange 30, and may permit the tab 34 to become embedded in the plasterboard panel, thus "locking" the tab in its end position. The inclination of the bending axis BB may be up to about 20°, but 11° has been found to be effective.

To assist in the "locking" action, the tabs 32 may have their upper edges 34 formed with one or more teeth or barbs which bite into the plasterboard panel when the tab is bent up.

As may be seen in FIG. 5*b*, tabs 32 are alternately provided along the length of the support spaced at two distinct distances from the flange 30. This is so that one support may accommodate plasterboard panels of two different thicknesses. The support may be formed from metal, for example aluminium, or may be extruded from plastics material, for example PVC. It has been found that PVC is suitable, since once the tabs 32 have been sufficiently bent they do not tend to spring back to their original position.

In an alternative embodiment, not illustrated, the tabs may be provided by forming a series of "L" shaped slots extending upwardly from the lower edge of the web 31 then along the web 31 parallel to the lower edge. The tabs would be bounded on two sides by the slot, on one side by the lower edge of the web 31, and on their remaining side by the bend axis BB. By providing "L" shaped slots of two heights, the support could be capable of accepting plasterboard panels of two thicknesses.

Figure 6:
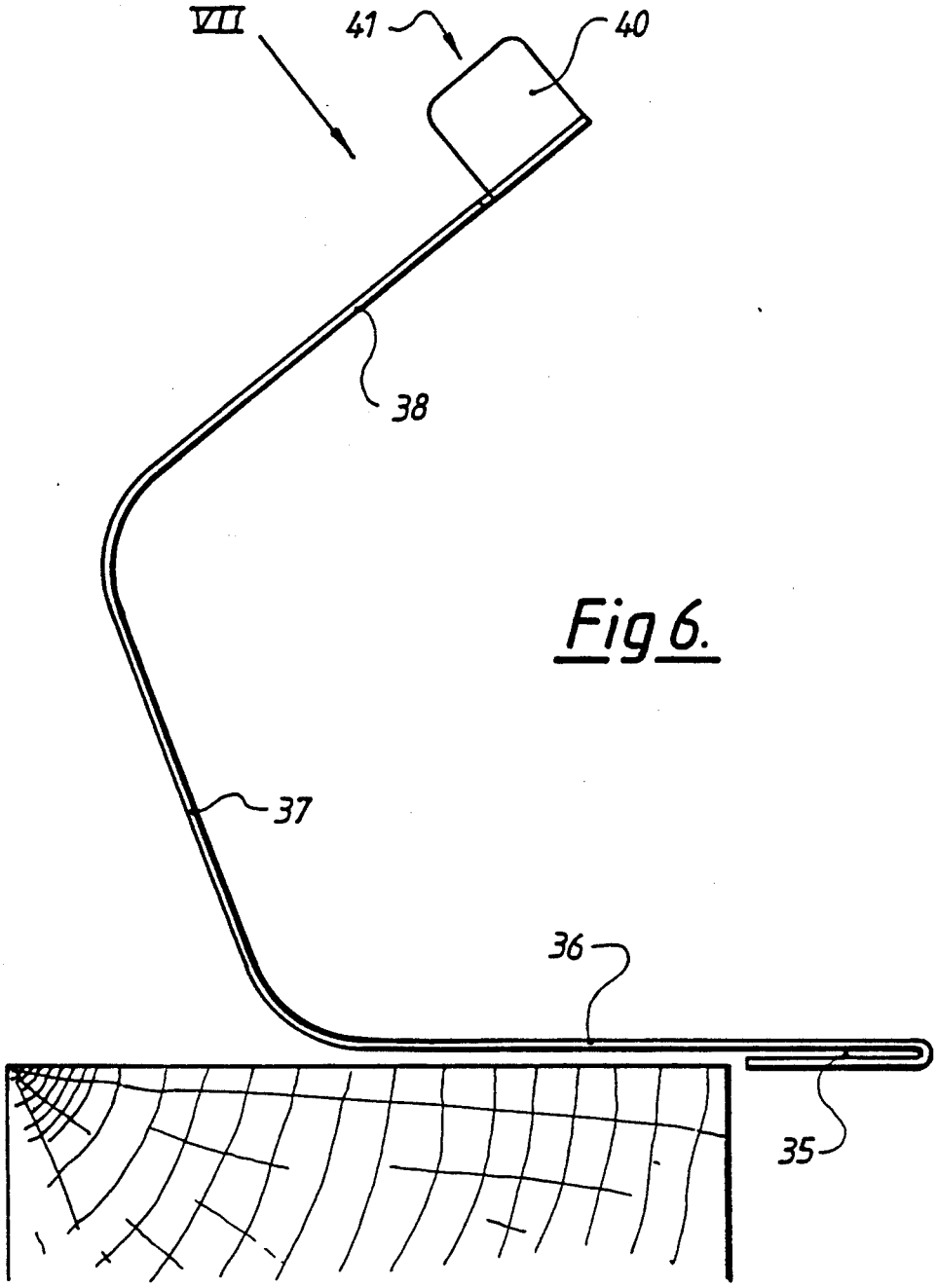
FIG. 6 shows an end view of an upstand.
Figure 7:
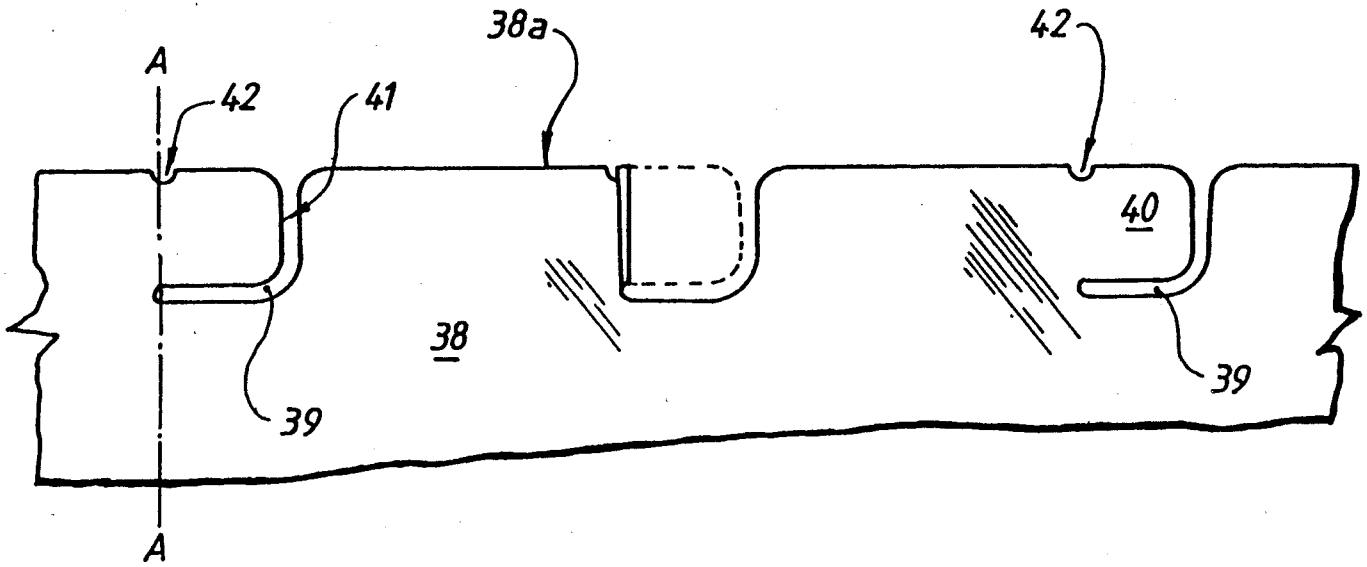
FIG. 7 shows a view of the upper edge portion of the upstand, viewed in the direction of arrow VII of FIG. 6.

FIGS. 6 and 7 show an upstand cooperable with the plasterboard support of FIGS. 5*a* and 5*b*. The upstand has a channel portion 35 engageable over the flange 30 of the plasterboard support, and a generally "U" shaped section to accommodate insulating material, defined by a base 36, a sidewall 37 and an upper wall 38.

The free edge 38*a* of upper wall 38, as seen in FIG. 7, is formed with a series of "L" shaped slots 39 extending inwardly from the edge 38*a* and then turning to extend parallel to the edge 38*a*.

Each slot 39 defines two sides of a rectangular spacing tab 40, whose other sides are defined by a portion of the edge 38*a* and a bend axis AA.

In use, the upstand is cut to the required length and pushed into the roofspace between the ends of the rafters so that the channel 35 engages the flange 30 of the plasterboard support, and the edge 38*a* of the upper wall 38 of the upstand lies adjacent the underside of the sloping roof.

In order to preserve the required ventilation gap between the insulation material and the roof, each tab 40 is bent so as to extend upwardly from the wall 38, the edge 41 of the tab 40 opposite its bend axis AA engaging the underside of the roof. Clearly, the tabs 40 may be of any convenient shape, provided that they ensure the required gap between the edge 38*a* and the underside of the roof.

To assist in accurately positioning the bend axis AA, a notch 42 may be provided in the edge 38*a* to form a "neck" at the desired bend line position.

Figure 8:
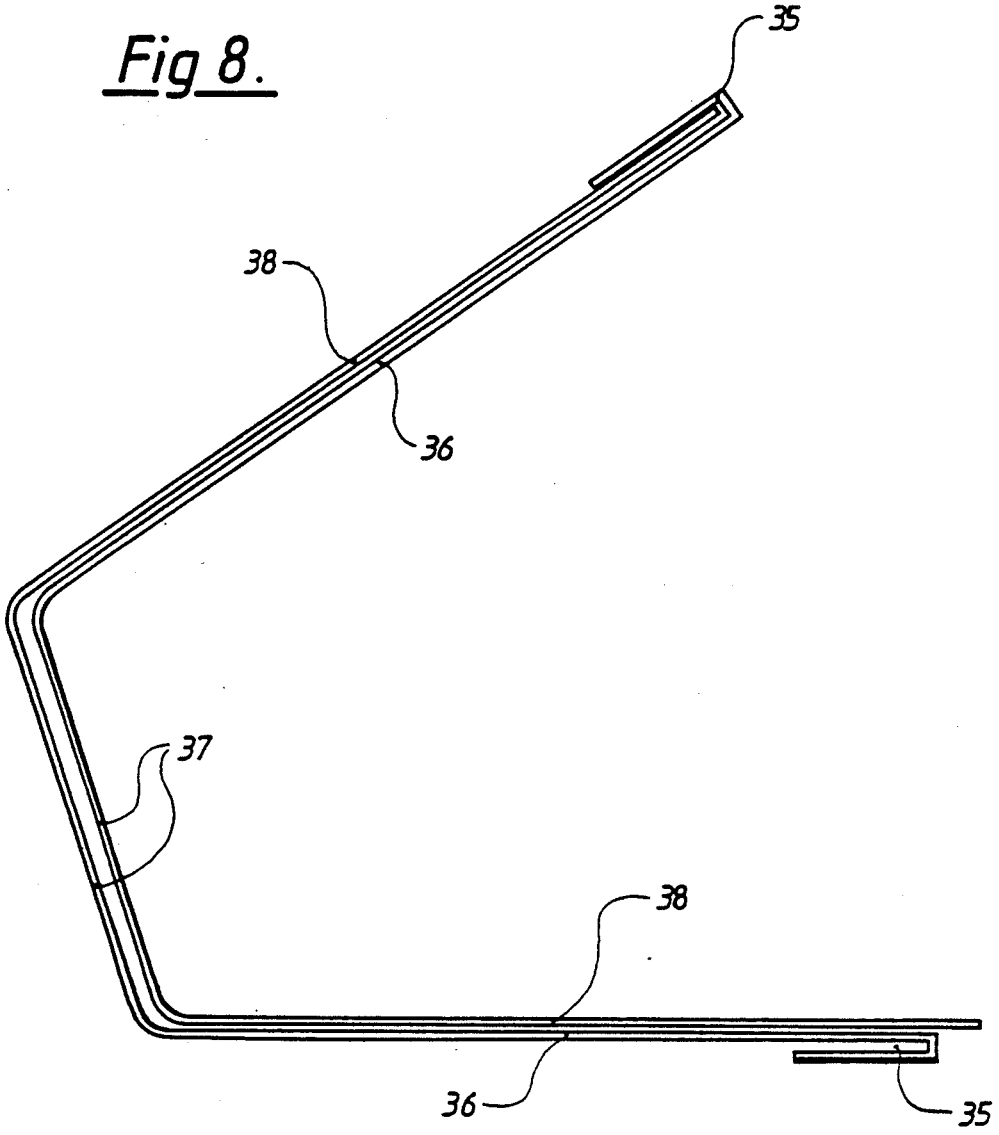
FIG. 8 shows two upstand sections nested together.

FIG. 8 shows how a section of the upstand may be inverted and "nested" within another identical section. Such a configuration is useful for sealing a butt joint between two upstand lengths when a loose granular insulating material is to be used, or to provide telescopic length adjustment between abutting upstand sections.

Since the plasterboard support is separate from the upstand, the plasterboard support may be installed in long lengths round the entire perimeter of each room of the building whereas the upstand need only be installed between the ends of the rafters supporting the roof.

FIGS. 9 and 9*a* show a further alternative arrangement, wherein a plasterboard support strip 40 is attached by nailing horizontally through its vertical web 41 into a wall plate 42, and an insulation-retaining upstand 43 is formed with a lip 44 extending downwardly from the free edge of its lower wall 45. The upstand 43 is held secure by nail 46 passing through both the web 41 and the lip 44.

The upper edge region of the upstand 43, shown to an enlarged scale in FIG. 9*a* which is a view in the direction of arrow A of FIG. 9, is formed with "C" shaped slots 47 which define three sides of rectangular bendable spacing tabs 48. As shown in FIG. 9, tabs 48 may be bent up at 90° to the plane of the upper wall 49 of the upstand 43 to ensure ventilation space between the upstand 43 and the roof.

Figure 10:
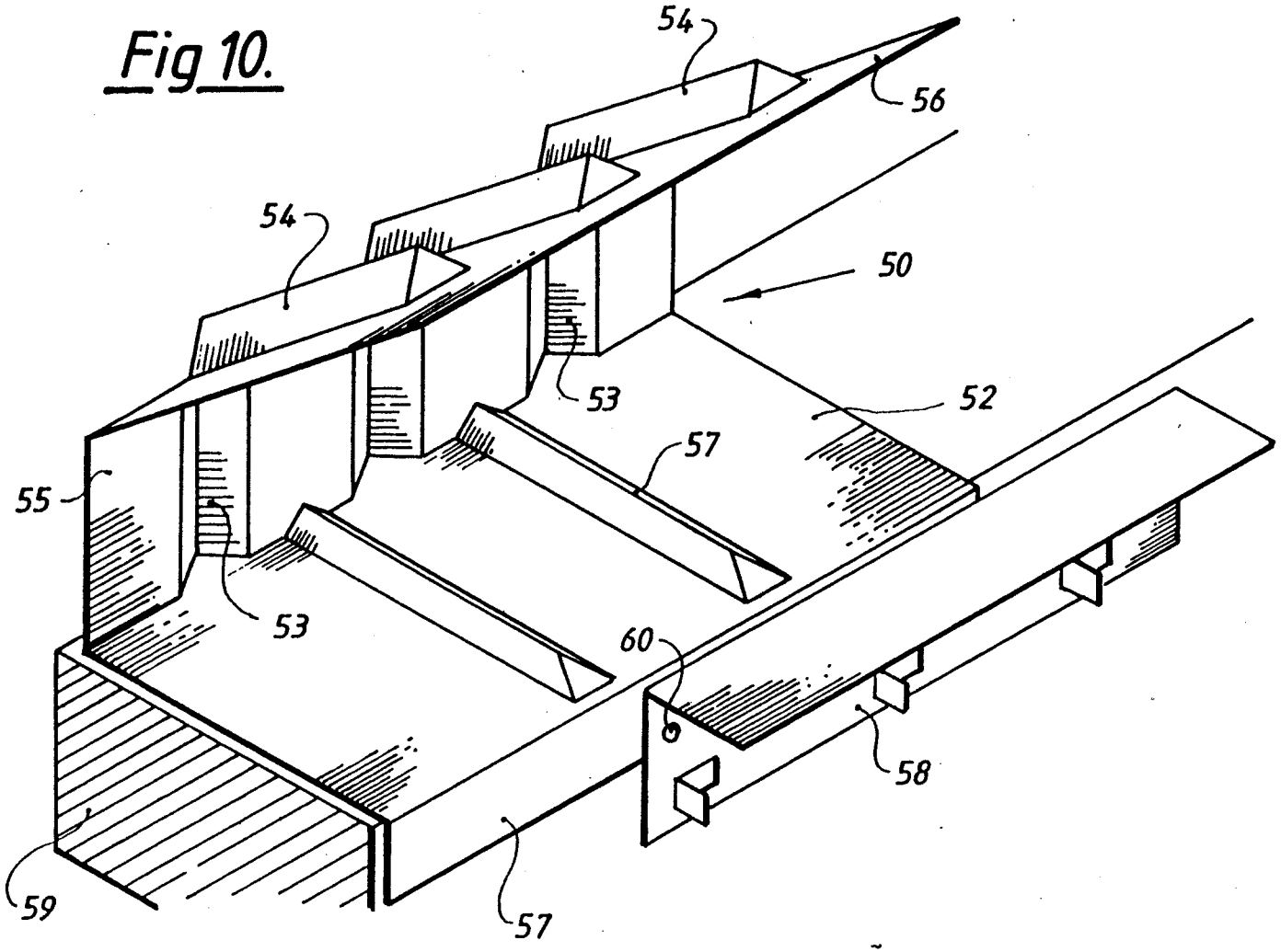
FIG. 10 is a perspective view of another embodiment of the insulation retaining upstand.

FIG. 10 shows an insulation-retaining upstand similar to that of FIG. 9, but produced by vacuum forming rather than by extrusion. The upstand 50 is provided with a plurality of inwardly extending stiffening corrugations 51 in its base 52, and outwardly extending corrugations 53 and 54 in its end wall 55 and its upper wall 56, respectively. A depending lip 57 extends down from the free edge of base 52, and in use is interposed between a plasterboard support 58 and a wall plate 59, to be secured by nails 60.

The insulation-retaining upstand 50 may conveniently be dimensioned so as to fit closely between the rafters placed at standard pitch spacings. Vacuum forming rather than forming by extrusion allows the upstand 50 to be of thinner material as compared to the previously described embodiments, thus saving cost.

While the plasterboard support and upstand sections have been primarily described in relation to the support of ceiling panels, it is to be understood that the plasterboard supports of FIGS. 3, 4, and 5 may be used separately from their upstands to support panel edges at other locations. The plasterboard support may be fixed to the masonry of the wall, rather than to the wall plate, as will be the case where the support is used to retain the edge of a plasterboard ceiling within a multi-story building.

What is claimed is:

1. An elongate supporting strip for supporting a ceiling panel edge adjacent a wall, comprising a first flange adapted to be fixed to the wall, a second flange extending longitudinally substantially perpendicularly to the first flange and adapted to overlie the panel in its final position, and locating means extending from the first flange at a predetermined distance below the second flange and adapted to engage the underside of the panel in its final position, wherein the locating means extending from the first flange comprises a plurality of bendable portions of the first flange attached to the remainder of the first flange at bend lines extending substantially perpendicularly to the length of the strip, wherein two series of bendable portions are formed in the first flange, the edges of the bendable portions facing the second flange being spaced therefrom by the first distance for the first series and by a second distance for the second series, so that by selectively bending only the bendable portions of one or other series panels of two distinct thicknesses may be accommodated.

2. A strip according to claim 1, wherein each bendable portion is formed with a barb on its side facing the second flange.

3. An elongate supporting strip for supporting a ceiling panel edge adjacent a wall, comprising a first flange adapted to be fixed to the wall, a second flange extending longitudinally substantially perpendicularly to the first flange and adapted to overlie the panel in its final position, and locating means extending from the first flange at a predetermined distance below the second flange and adapted to engage the underside of the panel in its final position, and further including an insulation receiving channel section having a base wall extending substantially horizontally from the upper edge of the first flange in a direction opposite to that of the second flange, an end wall extending generally upwardly from the base wall, and an upper wall extending obliquely upwardly from the end wall and overlying the base wall.

4. A supporting strip according to claim 3, wherein the insulation receiving channel is a separate component fixed to the supporting strip.

5. A supporting strip according to claim 3, wherein the free edge of the upper wall of the insulating receiving channel is formed with a series of slots extending in "L" form inwardly from the free edge and then parallel thereto, to define bendable spacer elements deformable to extend perpendicularly upwardly from the plane of the upper wall.

6. A supporting strip according to claim 3, wherein the base wall of the insulation receiving channel has a horizontal section and a downwardly inclined section, and the upper wall includes a substantially vertical section adjacent the end wall and an inclined section adjacent its free edge.

7. An elongate supporting strip for supporting a ceiling panel edge adjacent a wall, comprising a first flange adapted to be fixed to the wall, a second flange extending longitudinally of and substantially perpendicularly to the first flange and adapted to abut a first face of the ceiling panel, and a plurality of bendable portions situated at a predetermined distance from said second flange and partially defined by a slot cut through the first flange, the bendable portions being attached to the remainder of the first flange at bend lines extending in a direction inclined at an acute angle to the transverse direction of the strip, the bendable portions each having an edge nearest the second flange and extending substantially parallel thereto, and the said edges subtending an angle of more than 90° with said bend line, said edges of said bendable portions being adapted to engage a second face of the ceiling panel when said bendable portions are bent out of the plane of the first flange.

8. A supporting strip according to claim 7, and further including an insulation receiving channel section having a base wall extending substantially horizontally from the upper edge of the first flange in a direction opposite to that of the second flange, an end wall extending generally upwardly from the base wall, and an upper wall extending obliquely upwardly from the end wall, and overlying the base wall.

9. A supporting strip according to claim 8, wherein the insulation receiving channel is a separate component fixed to the supporting strip.

10. A supporting strip according to claim 8, wherein the face edge of the upper wall of the insulation receiving channel is formed with a series of slots extending in "L" form inwardly from the free edge and then parallel thereto, to define bendable spacer elements deformable to extend perpendicularly upwardly from the plane of the upper wall.

11. A supporting strip according to claim 8, wherein the lower wall of the insulation receiving channel has a horizontal section and a downwardly inclined section, the end wall is substantially horizontal, and the upper wall includes a substantially vertical section adjacent to the end and an inclined section adjacent its free edge.

12. A strip according to claim 7, wherein two series of bendable portions are formed in the first flange, the edges of the bendable portions facing the second flange being spaced therefrom by a first distance for the first series and by a second distance for the second series, so that by selectively bending only the bendable portions of one or other series panels of two distinct thicknesses may be accommodated.

13. A strip according to claim 12, wherein each bendable portion is formed with a barb on its side facing the second flange.

* * * * *